US007032712B2

(12) United States Patent
Schwörer

(10) Patent No.: US 7,032,712 B2
(45) Date of Patent: Apr. 25, 2006

(54) SCAFFOLD WITH VERTICAL SUPPORTS AND HORIZONTAL CARRIERS

(75) Inventor: Artur Schwörer, Senden (DE)

(73) Assignee: Peri GmbH, Weissenhorn (DE)

( * ) Notice: Subject to any disclaimer, the term of this patent is extended or adjusted under 35 U.S.C. 154(b) by 0 days.

(21) Appl. No.: 10/081,504

(22) Filed: Feb. 22, 2002

(65) Prior Publication Data

US 2002/0166726 A1 Nov. 14, 2002

(30) Foreign Application Priority Data

Feb. 23, 2001 (DE) ..... 101 08 784

(51) Int. Cl.
*G04G 1/00* (2006.01)

(52) U.S. Cl. ..... 182/178.1; 182/222; 182/119

(58) Field of Classification Search ..... 182/179.1, 182/178.1, 186.7, 186.8, 119, 222
See application file for complete search history.

(56) References Cited

U.S. PATENT DOCUMENTS

| | | | | |
|---|---|---|---|---|
| 4,802,553 | A * | 2/1989 | Waters et al. | 182/222 |
| 4,969,777 | A * | 11/1990 | Eickhoff | 108/157.1 |
| 6,027,276 | A * | 2/2000 | Schworer | 782/186.8 |
| 6,032,427 | A * | 3/2000 | Randjelovic | 52/584.1 |

FOREIGN PATENT DOCUMENTS

| | | |
|---|---|---|
| DE | 37 05 566 A1 | 9/1988 |
| DE | 40 27 754 A1 | 3/1992 |
| WO | WO 97/27372 | 7/1997 |

* cited by examiner

*Primary Examiner*—Alvin Chin-Shue
(74) *Attorney, Agent, or Firm*—Gifford, Krass, Groh, Sprinkle, Anderson & Cikowski, P.C.

(57) ABSTRACT

The invention relates to a scaffold with vertical supports arranged spaced apart next to one another and/or behind one another, with horizontal carriers arranged between adjacent vertical supports and with scaffold decks which releasably lie at their end regions on oppositely disposed horizontal carriers another and preferably extending parallel to one another, preferably by means of hooks,. The invention consists of the fact that the scaffold decks have at least one laterally projecting guide stop close to at least one end which can be slidingly placed on a horizontal carrier extending perpendicular to the horizontal carriers carrying the end regions of the relevant plate and arranged at the same height such that the scaffold deck held by an operator at the end remote from the guide stop can be displaced by sliding the guide stop on the associated horizontal carrier to the opposite horizontal carrier and can be pushed by tilting—preferably taking place after lowering of the end—about the side carrying the guide stop, at its end region, in particular the hooks, over the opposite horizontal carrier and can be placed into the position of use onto the associated opposite horizontal carriers by tilting back and lowering into the horizontal position.

21 Claims, 6 Drawing Sheets

SCAFFOLD WITH VERTICAL SUPPORTS AND HORIZONTAL CARRIERS

Figure 1:
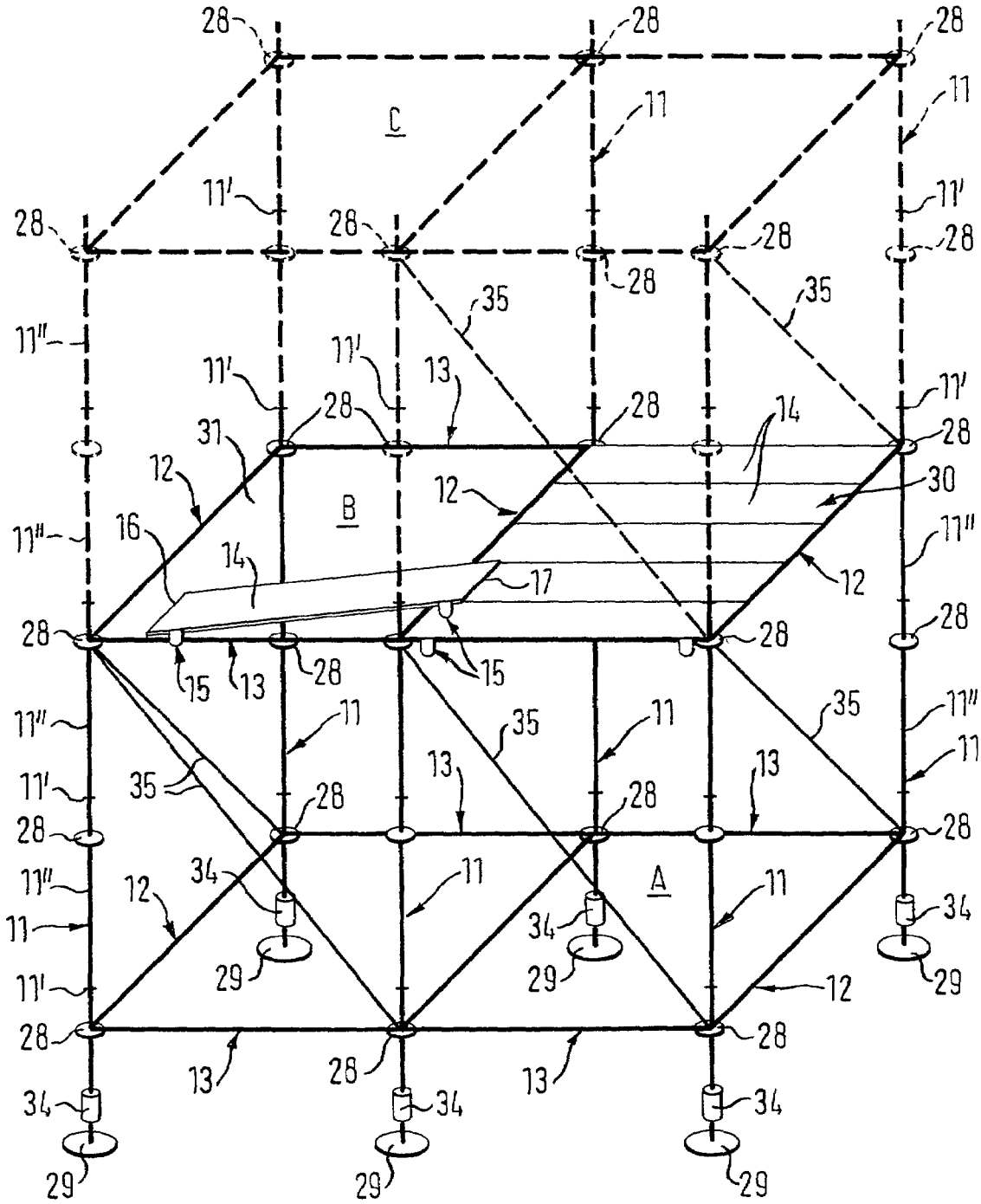

The invention relates to a scaffold in accordance with the preamble of claim 1.

Such scaffolds are frequently used, for example in the building sector, to enable work to be carried out, for example on a building under construction, at a certain height above the ground.

Such scaffolds preferably include vertical supports consisting of sections which can be individually plugged together and on which perforated roses are arranged at intervals of, for example, 0.5 m at which horizontal carriers and diagonal supports can be secured which connect adjacent vertical supports to one another so that a stable three dimensional scaffold is provided.

For the erection of such scaffolds, scaffold decks shaped like planks are inserted between oppositely disposed horizontal carriers which generally extend parallel to one another. The scaffold decks engage by means of hooks on the two associated horizontal carriers and are thereby fixed in a horizontal position, but are removable upwardly. Generally, a plurality of such scaffold decks are arranged next to one another on two opposite horizontal carriers. From the platform formed in this manner, scaffold decks can then be attached to adjacent horizontal carriers, or also to above lying horizontal carriers.

A problem with such scaffolds consists of the fact that for the insertion of a first scaffold deck between two oppositely disposed horizontal carriers which are parallel to one another, the scaffold deck can only be taken up at one end by the operator standing on the already completed platform, whereby the lifting of the other end is made very much more difficult, if not actually impossible. For this reason, planks are frequently used as aids which are longer than the spacing between the two oppositely disposed horizontal carriers, whereby the plank lifted at one end by the operator can be brought onto the remote horizontal carrier albeit only with substantial effort.

The aim of the invention consists of providing a scaffold of the kind initially mentioned in which the insertion of a first scaffold deck into an opening between horizontal carriers forming a square or a rectangle starting from an already completed platform is made substantially easier.

The features of the characterizing part of claim 1 are provided to satisfy this object.

The idea of the invention can therefore be seen in the fact that the end of the scaffold deck remote from the holding end is supported by placing the guide stop onto the horizontal carrier extending parallel to the scaffold deck and can be displaced on this up to the opposite horizontal carrier as if on a rail. By lowering the holding end and tilting about the longitudinal axis, the hook-like structures generally provided at the other end of the scaffold deck can then be pushed over the relevant horizontal carrier and then be brought into the final position of use by tilting back and fully lowering the scaffold deck.

In this connection, the guide stops must be arranged such that the securing hooks can be raised over the associated horizontal carrier by tilting the scaffold deck about its longitudinal axis and can be placed onto the horizontal carrier by tilting it back into the substantially horizontal position.

The embodiment in accordance with claim 2 has the advantage that the installation of the scaffold decks in accordance with the invention is possible irrespective of whether the horizontal carrier serving as the rail is disposed to the left or the right of the scaffold deck. A support by means of a guide stop can thus take place on the desired side thereof by turning the scaffold deck round into the appropriate direction.

So that the guide stops of the adjacent scaffold decks do not abut one another at the side in the event that two scaffold decks lie next to one another at their sides carrying the guide stops, the offsetting thereof in accordance with claim 3 is of advantage.

Advantageous practical embodiments of the guide stop can be found in claims 4 to 6.

By arranging an eyelet in accordance with claims 7, 8 on the side of the scaffold decks remote from the guide stop and at the same spacing from the end of the scaffold deck as the associated guide stop, it is possible to fix adjacent scaffold decks at a small distance to one another defined by the eyelet and the guide stops engaging therein. The guide stop fulfils a dual function in this embodiment.

The invention can be used with horizontal carriers made either of a single tube member in accordance with claims 9 to 11 or of two individual carriers, for example in C shape in accordance with claims 12 to 15, which extend closely spaced parallel to one another, with care having to be taken that the hooks provided at opposite ends of the horizontal carriers for the fixing of the scaffold decks are offset in a lateral direction relative to one another such that they do not collide with one another when two scaffold decks are arranged with their end faces adjoining one another.

The invention is used with particular advantage with vertical supports in accordance with claim 16. Hook and wedge arrangements for securing the horizontal carriers to the perforated roses are known from EP 0876541 A2.

Preferred embodiments of the plates and of the scaffold can be found in claims 17, 18 and 19.

Protection is also sought for a scaffold deck in accordance with claim 20.

The preferred method for the attachment of a scaffold deck in accordance with the invention is defined in claim 21.

Figure 2:
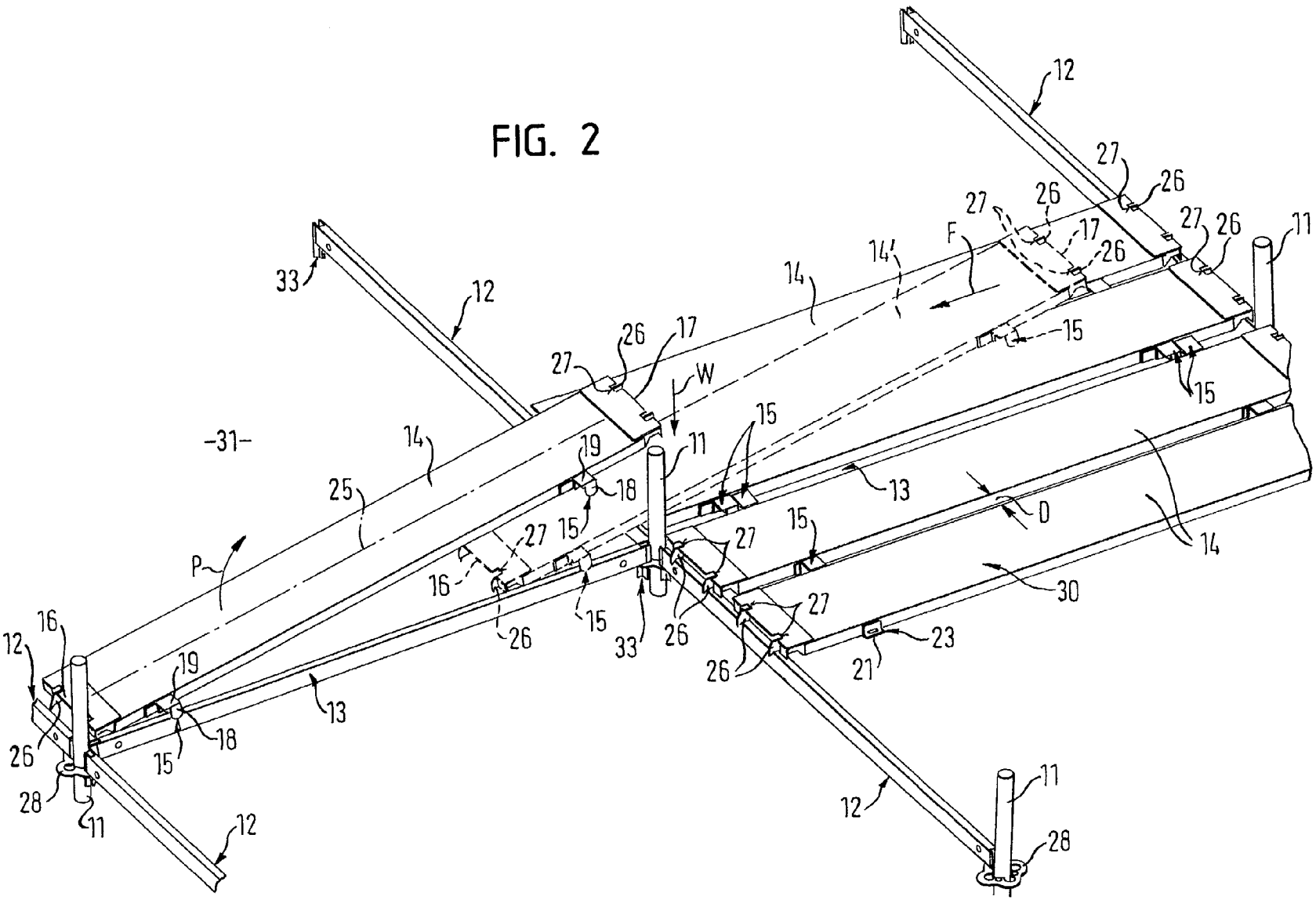
Figure 3:
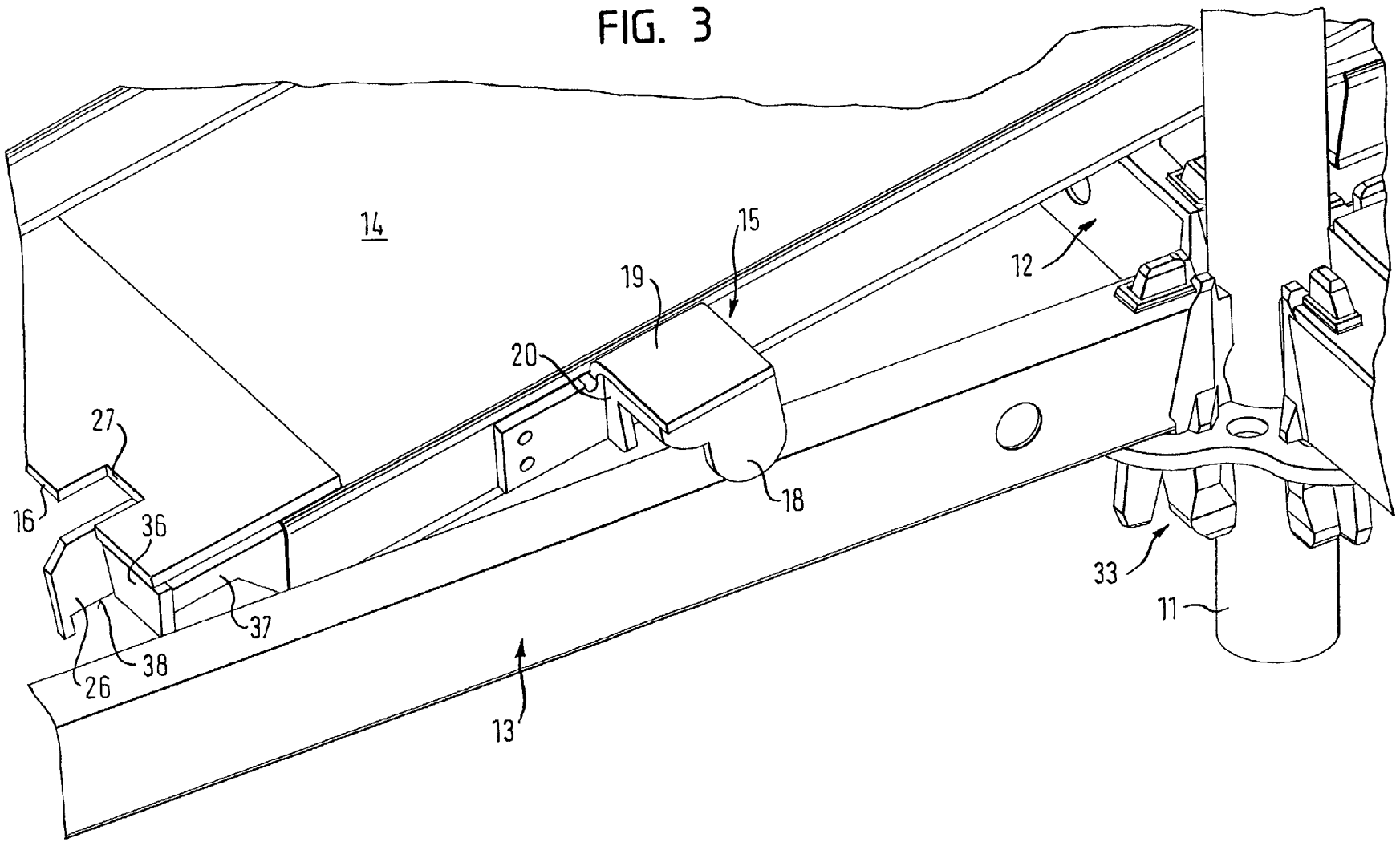
Figure 4:
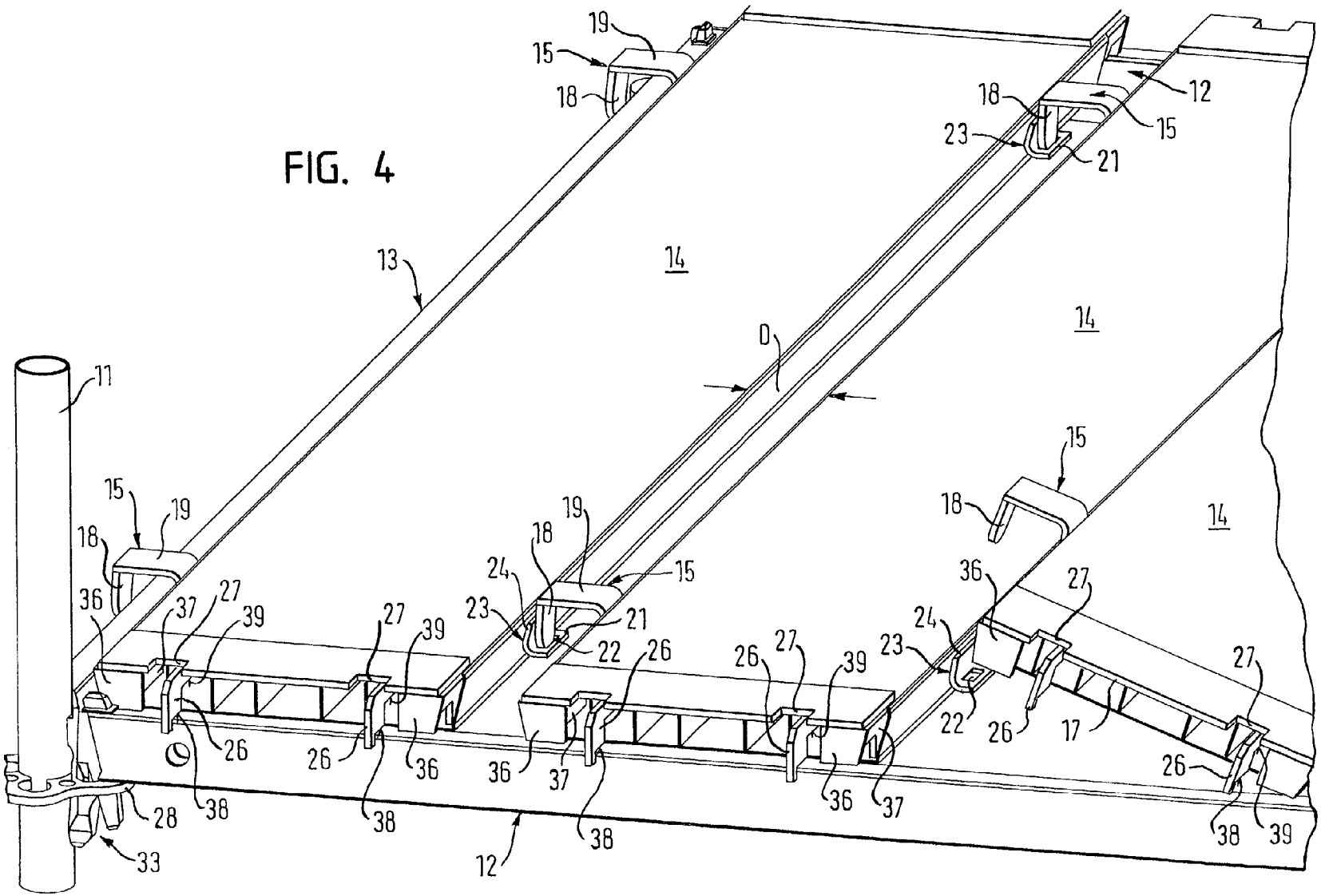
Figure 5:
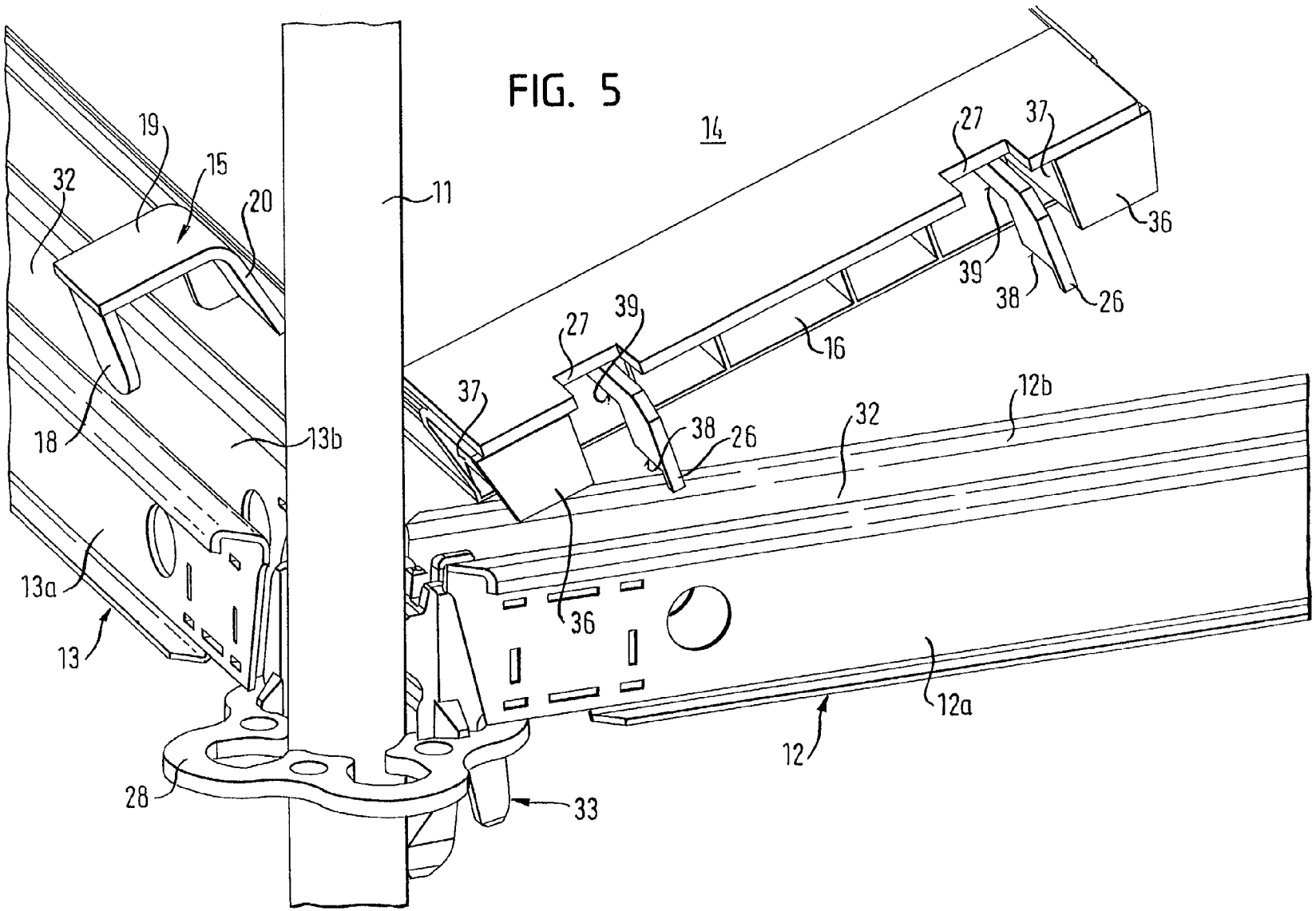
Figure 6:
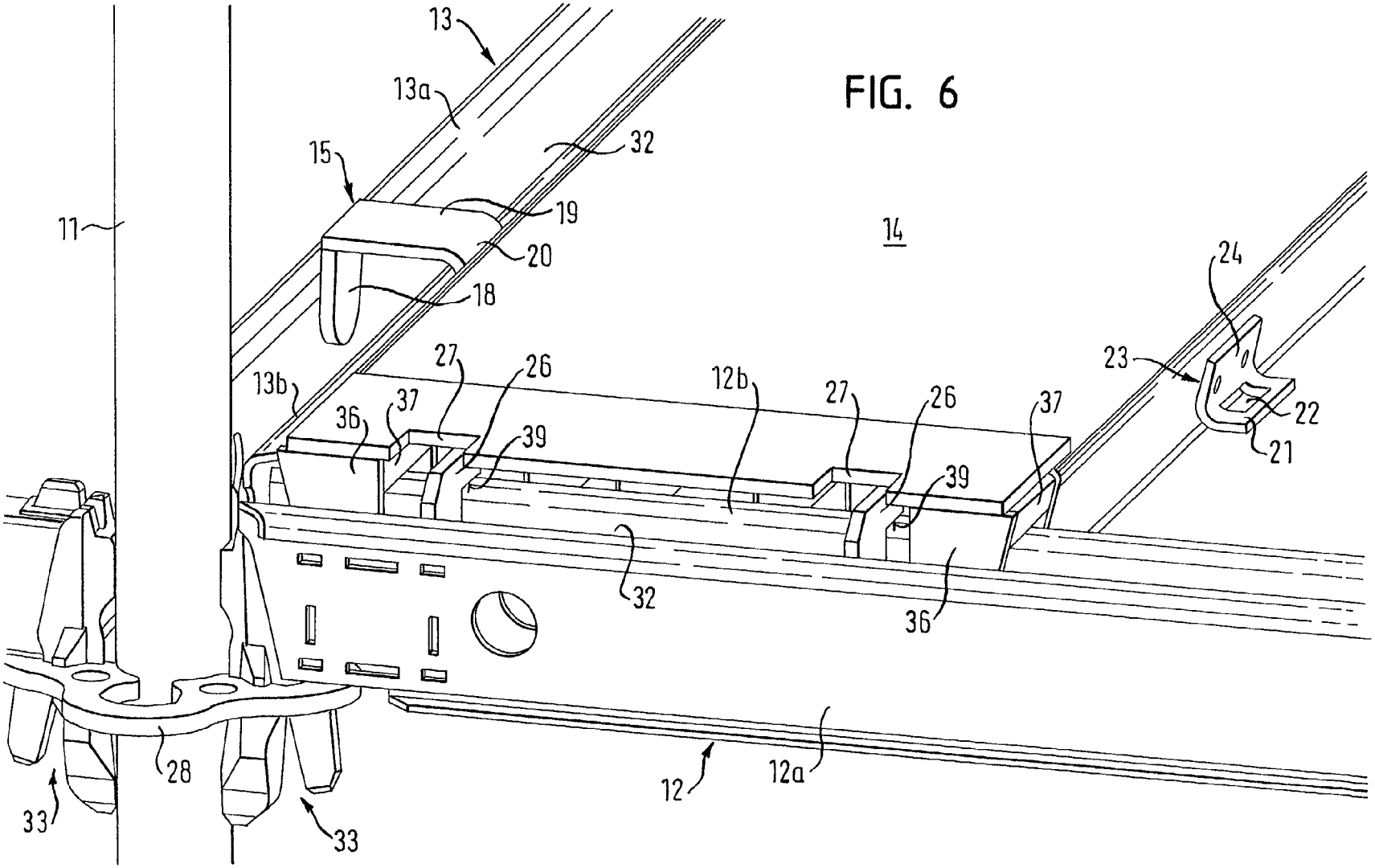

The invention will be described in the following by way of example with reference to the drawing, in which are shown:

FIG. 1 in a purely schematic perspective view, a scaffold in accordance with the invention with tubular horizontal carriers during the insertion in accordance with the invention of a scaffold deck into an open horizontal field of the scaffold from an already completed platform;

FIG. 2 a section of a scaffold in accordance with the invention considerably enlarged with respect to FIG. 1 to illustrate the insertion in accordance with the invention of a scaffold deck from an already completed platform;

FIG. 3 an enlarged perspective view of the end region of a scaffold deck including the guide stop at the start of the insertion procedure;

FIG. 4 an enlarged perspective part view of a scaffold in accordance with the invention to illustrate the insertion of a scaffold deck from already installed scaffold decks extending parallel thereto;

FIG. 5 a perspective view of a section of scaffold in accordance with the invention in the region of a vertical support which carries a perforated rose at which in each case two horizontal carriers consisting of individual carriers abut at a right angle during the final phase of the insertion of a scaffold deck; and FIG. 6 an enlarged perspective view of the object of FIG. 5 from a different direction in the finally inserted state of the scaffold deck.

In accordance with FIG. 1, a scaffold in accordance with the invention comprises a plurality of vertical supports 11 which are composed of sections 11" telescopically plugged together at connection points 11', which consist of tubes of round cross-section and which are each supported on the ground via a base plate 29. Screw jack arrangements 34 are generally also provided directly above the base plates 29 by means of which unevenness of the ground can be compensated for. The vertical supports 11 are arranged in pairs behind one another. Three such pairs of vertical supports 11 are provided next to one another at equal spacings. Both the vertical supports 11 disposed next to one another and the vertical supports 11 disposed behind one another are connected to one another above the base plates 29 by horizontal carriers 12 or 13, and indeed in a first tier A and a second tier B. The two tiers A and B are rectangular and extend horizontally. The connection of the ends of the horizontal carriers 12, 13 to the vertical supports 11 takes place via perforated roses 28 provided at the vertical supports such as are shown in detail in FIGS. 2 to 6, by means of hook and wedge arrangements 33 such as are described in EP 0876541.

The vertical spacing of the perforated roses 28 can, for example, amount to 0.5 to 1 m, while the vertical support sections 11" can, for example, be 1 to 2 m long.

Some of the adjacent vertical supports 11 are also connected to diagonal supports 35 engaging at their ends at perforated roses 28 to stabilize the scaffold.

For the further erection of the scaffold shown in only partly erected manner in FIG. 1, rectangular scaffold decks 14 are arranged in the tier B between the two right hand horizontal carriers 12 and form a working platform 30 from which a further platform of scaffold decks 14 flush with the platform 30 can be installed into an open square 31 to the left of the central upper horizontal carrier 12, with it being possible to install further vertical support sections 11", horizontal carriers 12, 13 and diagonal supports 35, which are indicated by broken lines in FIG. 1, above this to form a third tier C in which then further scaffold decks 14 can be inserted from below or from the side to form platforms.

As can be seen in a particularly illustrative manner from FIG. 4, the scaffold decks 14 have two laterally spaced hooks 26 at each of their ends with which they can be placed onto two horizontal carriers 12 arranged spaced apart and parallel to one another.

If, with such a scaffold, a platform 30 composed of one or more scaffold decks 14 is formed at a certain height, it is a problem to also likewise insert scaffold decks 14 between two respective horizontal carriers 12 extending parallel to one another in the adjacent open square 31, because the person handling the scaffold decks 14 is standing on the platform 30 and can only grip the scaffold deck 14 to be inserted first at its one end 17 (FIG. 2) to place the other end 16 onto the associated horizontal carrier 12. Since such scaffold decks 14 have a not insubstantial weight, it had previously been necessary to work with some aids such as long planks, etc. for its application in an open square 31.

To now facilitate the insertion of a scaffold deck 14 into an open square 31 of horizontal carriers 12, 13, in accordance with FIGS. 1 to 6, guide stops 15 are secured at one respective side of the scaffold decks, near their ends 16, 17, which consist, as can be seen in particular from FIGS. 3 and 4, of a flat contact part 19 extending laterally perpendicularly and horizontally away from the scaffold deck 14 and of a projection 18 projecting downwardly from the end of said contact part 19 remote from the scaffold deck 14 as well as of a securing flange 20 which likewise extends perpendicular to the contact part 19 and by means of which the guide stop 15 is secured to the scaffold deck 14. The spacing of the projection 18 from the securing flange 20 or from the associated side surface of the scaffold deck 14 is of a kind such that the guide stop 15 can be set from above onto a horizontal carrier 13 extending parallel to the scaffold deck 14 such that the projection 18 engages behind the horizontal carrier 13 and the contact part 19, and thus the relevant end region of the scaffold deck 14, can slide along on the horizontal carrier 13 as if on a rail.

In accordance with FIG. 2, a platform 30 has already been formed between the central and right hand horizontal carriers 12 by means of four scaffold decks 14 arranged next to one another from where a further platform should be erected in the adjacent open square 31. For this purpose, the first scaffold deck 14 to be inserted into the square 31 is placed by an operator with its guide stop 15 provided close to the end 16 on the horizontal carrier 13 extending parallel to the scaffold deck 14, whereby the end 16 of the scaffold deck is guided in rail-like manner on the horizontal carrier 13. This position of the scaffold deck at the start of the insertion procedure is illustrated in broken lines at 14' in FIG. 2. The operator now holds the scaffold deck 14' in the shown inclined position in the region of its end 17 and pushes it in the direction of the arrow F along the horizontal carrier 13 over the position shown in FIG. 1 up to the position shown in solid lines in FIG. 2, where the end 16 is located close to the one left hand horizontal carrier 12.

Subsequently, the end 17 of the scaffold deck 14 in an inclined position is then lowered in the direction of the arrow W, with the guide stop 15 provided in the region of the end 17 also being laid over the horizontal carrier 13. Subsequently, the scaffold deck 14 is then tilted so far about the contact points of the guide stops 15 in the sense of the arrow P in FIG. 2 until the two hooks 26 provided at the end 16 enter into a position above the associated horizontal carrier 12, whereupon the plate is again displaced in the direction of the arrow F into its end position in which the pairs of hooks 26 come to rest at both ends 16, 17 above the horizontal carriers 12. If, subsequently, the scaffold deck 14 is lowered into the horizontal position, the hooks 26 are laid over the associated horizontal carriers 12 as can be recognized in a particularly illustrative manner in FIG. 4.

The adjacent scaffold decks 14 can then be inserted without problem from the scaffold deck 14 now fixed inside the upper square 31 in FIG. 2.

It can be seen from FIGS. 2 and 4 how this can be done in detail so that a defined small spacing D can be maintained between adjacent scaffold decks 14.

Respective angled plates 23 are attached to the respective side of the same scaffold deck 14 remote from a guide stop 15 and comprise a limb 24 secured to the side of the scaffold deck 14 and a horizontal limb 21 in which an opening 22 is provided which is formed complementary to the projection 18 at the oppositely disposed guide stop 15 such that—as can in particular be recognized from FIG. 4—the downwardly extending projection 18 of the guide stop 15 of an adjacent scaffold deck 14 can be inserted from above into the opening 22 to ensure the low spacing D in this manner.

It can be recognized at the right in FIG. 4 how a scaffold deck 14 with the hooks 26 can be inserted from above onto the horizontal carrier 12 and with the projection 18 of the guide stop 15 into the opening 22 of the angled plate 23.

Since only one horizontal carrier 12 each is available for the attachment of the ends 16, 17 of adjacent two scaffold decks 14 at these ends, the ends 16, 17 of the scaffold decks 14 in accordance with FIGS. 2 to 4 must be made such that the hooks 26 can engage over the common horizontal carrier 12 at the two opposite ends 16, 17 without colliding with one another.

For this purpose, the hooks 26 are offset with respect to one another relative to the axis of symmetry 25 (FIG. 2) at the two ends 16, 17 of a scaffold deck 14 such that they come to rest next to one another with the ends 16, 17 of two scaffold decks 14 confronting opposite one another at the end faces. To create space for the respective hook of the opposite scaffold deck 14, correspondingly laterally offset recesses 27 should be provided in the ends 16, 17 in each case next to the hooks 26. In FIG. 2, the arrangement and offset of the hooks 26 and also of the recesses 27 at the two ends 16, 17 of the scaffold decks 14 can be recognized.

In accordance with FIGS. 5 and 6, the horizontal carriers 12, 13 each consist of individual carriers 12*a*, 12*b* or 13*a*,13*b* arranged parallel to one another, which have a substantially C-shaped cross-section, with the two limbs of the C section pointing away from one another and the two webs extending parallel to one another at a small spacing. An intermediate space 32 into which, in accordance with FIGS. 5 and 6, the projection 18 of the guide stop 15 and the hooks 26 can engage from above is therefore located between the individual carriers 12*a*, 12*b* or 13*a*, 13*b*.

The offset of the hooks 26 at the ends 16 or 17 relative to the longitudinal axis of symmetry 25 of the scaffold decks 14 (FIG. 2) and the correspondingly offset recesses 27 should also be present in the embodiment in accordance with FIGS. 5 and 6 so that there is still room to the left of the hooks 26 which can be recognized in FIG. 6 for the hooks 26 at the end of the scaffold deck 14 opposite the plate 14 at the end face.

To the right of the central lower horizontal carriers 12 shown in FIG. 2 it can be recognized that the two guide stops 15 secured at the side to a scaffold deck 14 have different spacings from the two ends 16, 17 of the scaffold decks 14, and indeed such that with scaffold decks 14 disposed with the sides carrying the guides stops 15 next to one another in the position of use, the guide stops 15 come to rest behind one another in the longitudinal direction of the scaffold decks 14 in accordance with FIG. 2 and thus also ensure the small spacing D between adjacent scaffold decks 14 visible from FIG. 4 when the scaffold decks 14 are arranged next to one another with the guide stops 15 facing one another on the horizontal carriers 12, as is shown in FIG. 2 for the two central scaffold decks 14 between the central and right hand horizontal carriers 12.

In accordance with FIGS. 3 and 4 support plates 36 are provided preferably at a right angle to the hooks 26 and approximately coinciding with the end 17 (or 16) laterally outside of the hooks 26 or recess 27, said support plates being supported in the position of use in accordance with FIG. 4 at the upper surface of the horizontal carriers 12 and thus increasing the lateral tilt stability of the scaffold decks 14. The support plates 36 extend for this purpose at both sides approximately up to the side surfaces of the scaffold deck 14.

In accordance with FIGS. 4, 5, the hooks preferably have two vertically and horizontally offset carrying edges 38, 39 of which the outer (38) serves for the support on a horizontal carrier 12 in accordance with FIGS. 2 to 4 and the inner (39) serves for the support on an individual carrier 12*b* or (12*a*) in accordance with FIGS. 5, 6.

Since the support plates 36 engage between the individual carriers 12*a*, 12*b* in the embodiment in accordance with FIGS. 5, 6, because here the inner carrying edges 39 of the hooks 26 come into action, support webs 37 are preferably provided parallel to the surfaces of the plate-like hooks 26 at one or both sides of the support plates 36, said support webs lying in the position of use in accordance with FIG. 6 from above on the associated individual carrier 12*b* (or 12*a*) and thus also ensuring the advantageous tilt stability here.

REFERENCE NUMERAL LIST

| | |
|---|---|
| 11 | vertical support |
| 11' | vertical support section |
| 12 | horizontal carrier |
| 12a | individual carrier |
| 12b | individual carrier |
| 13 | horizontal carrier |
| 13a | individual carrier |
| 13b | individual carrier |
| 14 | scaffold deck |
| 15 | guide stop |
| 16 | end |
| 17 | end |
| 18 | projection |
| 19 | contact part |
| 20 | flange |
| 21 | limb |
| 22 | opening |
| 23 | angled plate |
| 24 | limb |
| 25 | axis of symmetry |
| 26 | hook |
| 27 | recess |
| 28 | perforated rose |
| 29 | base plate |
| 30 | platform |
| 31 | square |
| 32 | intermediate space |
| 33 | hook and wedge arrangement |
| 34 | screw jack arrangement |
| 35 | diagonal support |
| 36 | support plate |
| 37 | support web |
| 38 | carrying edge |
| 39 | carrying edge |

What is claimed is:

1. A scaffold comprising:

a plurality of vertical supports (11) arranged spaced apart beside one another and behind one another, between which:

tiers (A, B, C) are arranged one above the other realised by:

a plurality of first horizontal carriers (12) extending parallel to one another between adjacent vertical supports, a plurality of second horizontal carriers (13) extending parallel to one another between adjacent vertical supports and arranged perpendicular to said first horizontal carriers (12) at the same height; and a plurality of rectangular scaffold decks (14) each having two long and two short sides (16, 17) and holding means being provided at the two short sides. and wherein said decks are releasably supported in the assembled state of the scaffold through the holding means on two adjacent first horizontal carriers (12);

a plurality of diagonal braces (35) being connected to adjacent vertical supports (11) characterized in that;

the decks (14) have at least one guide stop (15) projecting from one of said long sides and close to but spaced from at least one of said short sides (16, 17), said guide stop extending along only a portion of said deck and is adapted to be slidingly placed on a second horizontal cater (13) in such a manner that check (14) held by an operator at the short side (17) remote from the guide stop (15) and operative to be displaced by sliding the guide stop (15) on the second horizontal carrier (13) to an opposite first horizontal carrier (12) and which is projecting to such an extent from said one side that by tilting the deck about the second horizontal carrier (13) on which the guide stop rests, said holding means is positioned higher than the opposite first horizontal carrier (12) so that the deck can be pushed to a position where said holding means is positioned over the opposite first horizontal carrier (12) and brought to rest into the position of use thereon, where the holding means have engaged the first horizontal carriers, by tilting back and lowering the deck into the horizontal position whereupon said holding means supports said deck upon said first horizontal carriers.

2. A scaffold in accordance with claim 1, wherein two guide stops (15) are provided at one of said two long sides wherein one of said two guide stops is close to each one of said two short sides (16, 17) of the scaffold decks (14).

3. A scaffold in accordance with claim 2, wherein said two guide stops (15) provided at one scaffold deck (14) have a spacing from the two short sides(16, 17) of the scaffold deck (14) which differs such that when two long sides, which comprise the two guide stops (15), of two scaffold decks (14) lie adjacent one another on a single horizontal carrier (12) while in use, the two guide stops (15) are mutually offset in a longitudinal direction of the two scaffold decks such that the two guide stops of each scaffold deck rest adjacent one another and each abuts or contacts side surfaces of the adjacent scaffold deck (14).

4. A scaffold in accordance with claim 1, wherein the at least one guide stop (15) comprise a contact part (19) which is horizontal in a position of use, which can engage over an associated horizontal carrier (13) and which has a downwardly extending projection (18) at an end remote from the scaffold deck (14) which engages around the associated horizontal carrier (13) when being pushed on, during lowering and after lowering of the scaffold deck (14).

5. A scaffold in accordance with claim 4, wherein each guide stop (15) is made as an angled plate, with one limb fanning the contact part (19) and another limb forming the projection (18).

6. A scaffold in accordance with claim 1, wherein the at least one guide stop (15) is secured to a side of the scaffold deck (14) by means of an angled flange (20).

7. A scaffold in accordance with claim 1, wherein the second horizontal carriers (13) comprise of a tube member behind which said holding means (26) engage which are offset relative to a longitudinal axis of symmetry (25) of the scaffold decks (14) and are offset from at the two short sides of the scaffold decks (14) and are adjacent co one another on the second horizontal carrier (13).

8. A scaffold in accordance with claim 7, wherein the tube member has a rectangular or round cross-section.

9. A scaffold in accordance with claim 7, further comprising recesses (27) next to the holding means (26) at the two short sides of the scaffold decks (14) into which holding means (26) of a scaffold deck (14) adjoining at each short side can engage.

10. A scaffold in accordance with claim 7, wherein the first arid second horizontal carriers (12, 13) consist of two parallel individual carriers (12*a*, 12*b*; 13*a*, 13*b*) arranged at a small spacing.

11. A scaffold in accordance with claim 10, wherein the at least one guide stop (15) only engages over an individual carrier (13b) directly adjacent to the scaffold deck (14).

12. A scaffold in accordance with claim 10, wherein the holding means (26) at short side (16) of the scaffold decks (14) engage behind individual carriers (12*a*, 12*b*).

13. A scaffold in accordance with claim 10, wherein the holding means (26) at the two short sides (16, 17) of a scaffold deck (14) are mutually offset with respect to a longitudinal axis of symmetry (25) such that the holding means (26) of two scaffold decks (14) adjoining one another at the two short sides and engaging behind one individual carrier (12*a*, 12*b*) come to rest next to one another.

14. A scaffold in accordance with claim 1, wherein the vertical supports (11) carry perforated roses (28) at vertical intervals at which ends of the horizontal carriers (12, 13) are secured, by means of hook and wedge arrangements (33).

15. A scaffold in accordance with claim 1, wherein the scaffold decks (14) are elongate rectangles.

16. A scaffold in accordance with claim 1, wherein four vertical supports (11) are in each case arranged at the corners of a square, and carry said horizontal carriers (12, 13), at pre-determined vertical intervals.

17. A scaffold in accordance with claim 1, wherein the vertical supports (11) consist of a plurality of vertical support sections (11') telescopically joined together.

18. A scaffold deck (14) for a scaffold in accordance with claim 1.

19. A method of installing a scaffold deck on a scaffold in accordance with claim 1, said method comprising:

gripping the scaffold deck (14) at one short side (17);

setting the at least one guide stop (15) remote from the one short side (17) onto a second horizontal carrier (13) that extends parallel to The scaffold deck (14);

sliding the at least one guide stop (15) on the second horizontal carder (13) until an opposing short side (16) remote from the one short side (17) approaches or contacts a first horizontal carrier (12);

tilting the deck about the second horizontal carrier (13) on which the guide stop rests to an extent that said holding means is positioned higher than the opposite first horizontal carrier (12);

pushing the deck to a position where said holding means is positioned over the opposite first horizontal carder (12); and bringing the holding means to rest into the position of use thereon where the holding means have engaged the first horizontal carriers, by tilting back and lowering the deck into the horizontal position.

20. A scaffold comprising:

a plurality of vertical supports (11) arranged spaced apart beside one another and behind one another, between which:

tiers (A, B, C) are arranged one above the oilier realised by;

a plurality of first horizontal carriers (12) extending parallel to one another between adjacent vertical supports, a plurality of second horizontal carriers (13) extending parallel to one another between adjacent vertical supports and arranged perpendicular to said first horizontal carriers (12) at the same height; and a plurality of rectangular scaffold decks (14) each having two long and two short sides (16, 17) and holding means being provided at the two short sides, and wherein said decks are releasably supported in the assembled state of the scaffold through the holding means on two adjacent first horizontal carriers (12);

a plurality of diagonal braces (35) being connected to adjacent vertical supports (11) characterized in that:

the decks (14) have at least one guide stop (15) projecting from one of said long sides and close to but spaced from at least one of said short sides (16, 17), said guide stop extending along only a portion of said deck and is adapted to be slidingly placed on a second horizontal carrier (13) in such a manner that the deck (14) held by an operator at the short side (17) remote from the guide stop (15) and operative to be displaced by sliding the guide stop (15) on the second horizontal carrier (13) to an opposite first horizontal carrier (12) and which is projecting to such an extent from said one side that by tilting the deck about the second horizontal carrier (13) on which the guide stop rests, said holding means is positioned higher than the opposite first horizontal carrier (12) so that the deck can be pushed at position where said holding means is positioned over the opposite first horizontal carrier (12) and brought to rest into the position of use thereon, where the hoking means have engaged the first horizontal carriers, by tilling back and lowering the deck into the horizontal position whereupon said holding means supports said deck upon said first horizontal carriers, wherein the at least one guide stop (15) comprise a contact part (19) which is horizontal in a position of use, which can engage over an associated horizontal carrier (13) and which has a downwardly extending projection (18) at an end remote from the scaffold deck (14) which engages around the associated horizontal carrier (13) when being pushed on, during lowering and after lowering of the scaffold deck (14), and wherein an eyelet (21) is secured to a side of the scaffold deck (14) remote from the guide stop (15) wherein said eyelet includes an opening (22) made complementary to the projection (18) such that the projection (15) of an adjacent scaffold deck (14) can engage into the opening (22) to thus hold the adjacent scaffold decks (14) at a defined, small spacing (D).

21. A scaffold in accordance with claim 20, wherein the eyelet is made as a limb (21) of an angled plate (23) wherein a second limb (24) of the angled plate (23) is secured to the side of the scaffold deck (14).

* * * * *